US008261953B2

(12) United States Patent
McSavaney

(10) Patent No.: US 8,261,953 B2
(45) Date of Patent: Sep. 11, 2012

(54) BEVERAGE CONTAINER AND CLOSURE

(76) Inventor: Craig McSavaney, Boulder, CO (US)

( * ) Notice: Subject to any disclaimer, the term of this patent is extended or adjusted under 35 U.S.C. 154(b) by 834 days.

(21) Appl. No.: 12/330,388

(22) Filed: Dec. 8, 2008

(65) Prior Publication Data

US 2009/0148079 A1 Jun. 11, 2009

Related U.S. Application Data

(60) Provisional application No. 61/007,009, filed on Dec. 10, 2007.

(51) Int. Cl.

| | |
|---|---|
| ***A45F 3/16*** | (2006.01) |
| ***B65D 53/00*** | (2006.01) |
| ***B65D 1/46*** | (2006.01) |
| ***B65D 1/42*** | (2006.01) |
| ***B65D 6/34*** | (2006.01) |
| ***B65D 8/08*** | (2006.01) |
| ***B65D 5/72*** | (2006.01) |
| ***B65D 25/40*** | (2006.01) |
| ***B65D 35/38*** | (2006.01) |
| ***B65D 33/00*** | (2006.01) |
| ***B65D 33/02*** | (2006.01) |
| ***B67D 3/00*** | (2006.01) |

(52) U.S. Cl. ..... 224/148.1; 224/148.3; 224/148.7; 215/271; 215/42; 220/639; 220/640; 220/643; 222/478; 222/490; 222/481; 222/491; 383/33; 383/34; 383/34.1

(58) Field of Classification Search ..... 224/148.1, 224/148.3, 148.7; 215/271, 42; 220/639, 220/640, 643; 222/478, 490, 481, 491; 383/33–34.1
See application file for complete search history.

(56) References Cited

U.S. PATENT DOCUMENTS

| | | | | | |
|---|---|---|---|---|---|
| 1,138,882 | A | * | 5/1915 | Meier | 150/150 |
| 1,145,953 | A | * | 7/1915 | Wheaton | 383/16 |
| 1,202,085 | A | * | 10/1916 | Mitchell | 383/33 |
| 1,508,724 | A | * | 9/1924 | Rose | 224/148.7 |
| 1,658,294 | A | | 9/1925 | Lewis | |
| 1,751,237 | A | * | 3/1930 | Hoban | 222/544 |
| 2,005,642 | A | * | 6/1935 | Thornton | 222/490 |
| 2,107,216 | A | | 2/1938 | Rogers | |
| 2,125,354 | A | | 8/1938 | Meier | |
| 2,507,248 | A | * | 5/1950 | De Swart | 222/494 |
| 2,868,254 | A | * | 1/1959 | Saad | 150/151 |
| 3,110,335 | A | * | 11/1963 | Antonius | 383/43 |
| 3,179,301 | A | * | 4/1965 | Lucht | 222/213 |
| 3,272,248 | A | | 9/1966 | O'Farrell | |
| 3,342,318 | A | * | 9/1967 | Ruekberg et al. | 206/540 |
| 3,481,513 | A | * | 12/1969 | Ram | 222/490 |
| 3,817,428 | A | * | 6/1974 | Buckley | 222/173 |
| 4,332,344 | A | * | 6/1982 | Strodthoff | 383/63 |
| 5,005,734 | A | * | 4/1991 | Van Gordon et al. | 222/107 |
| 5,059,035 | A | * | 10/1991 | Kristensen | 383/33 |
| 5,116,139 | A | * | 5/1992 | Young et al. | 383/49 |
| 6,022,144 | A | | 2/2000 | Hausslein | |
| 6,345,911 | B1 | * | 2/2002 | Young et al. | 383/6 |
| 6,361,210 | B2 | | 3/2002 | Denko | |
| 6,886,739 | B1 | * | 5/2005 | Tsengas | 232/43.1 |
| 7,175,069 | B1 | * | 2/2007 | Tsengas | 232/43.1 |

(Continued)

*Primary Examiner* — Nathan J Newhouse
*Assistant Examiner* — Derek Battisti

(57) ABSTRACT

A resilient unitary beverage container comprises a body portion, a ring portion, and a lid portion. In one embodiment, the body portion comprises a fluid reception cavity and has a first thickness. The ring portion is integrated to the body portion and comprises a second thickness. The lid portion comprises a spout and an opening, with the lid portion having a third thickness and also being integrated to the ring portion.

14 Claims, 5 Drawing Sheets

U.S. PATENT DOCUMENTS

2004/0208400 A1* 10/2004 Linneweil ..... 383/68
2005/0017029 A1* 1/2005 Laverdure ..... 222/490
2006/0140515 A1* 6/2006 Inaba et al. ..... 383/104
2008/0233252 A1* 9/2008 Manning et al. ..... 426/412

* cited by examiner

BEVERAGE CONTAINER AND CLOSURE

PRIORITY CLAIM

The present application claims the benefit of Provisional U.S. Patent Application No. 61/007,009 filed on Dec. 10, 2007. The details of Application No. 61/007,009, as well as U.S. patent application Ser. No. 29/312,561, filed on Oct. 30, 2008, are incorporated by reference into the present application in their entirety and for all proper purposes.

FIELD OF THE INVENTION

Aspects of devices constructed in accordance with the present invention generally relate to beverage containers. In particular, but not by way of limitation, aspects of devices constructed according to the present invention relate to beverage containers and beverage container closures adapted for use during a sporting competition.

BACKGROUND OF THE INVENTION

It is often necessary to intake fluids while participating in a sporting competition in order to sustain the energy required to perform at a desired competition level and to replenish fluids lost during the competition, through perspiration or otherwise. One genre of sporting competitions where the intake of fluids is prevalent by many of the participants is endurance sporting events. For example, during the course of a road running race such as, but not limited to, a marathon, various fluid intake stations may be set up along the racecourse. These stations often provide cups of water, Gatorade®, or other fluids to the race participants.

As is often the case, participants are unlikely to intake a desired amount of fluid due to the nature of the fluid intake stations and the associated beverage containers located at the stations. For example, many fluid intake stations provide participants disposable 5 or 7 oz. cups of fluid either through race volunteers handing the cups to participants or through placing the cups on tables along the racecourse. As many participants wish to achieve as fast a time as possible in the sporting event, participants often fail to slow their pace while drinking from the cup, causing a substantial amount of spillage to occur. Therefore, the cup may fail to provide an adequate amount of fluid, and the race participant must wait until the next station to obtain more fluid. A better way to provide fluid to race participants is needed.

SUMMARY OF THE INVENTION

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

Aspects of devices constructed in accordance with the present invention provide a beverage container and a beverage container closure. One embodiment of a beverage container comprises resilient body, ring, and lid portions. One resilient body portion is comprised of a first thickness and a fluid reception cavity. One ring portion is comprised of a second thickness, and one lid portion is comprised of a third thickness, a spout, and an opening. Furthermore, the ring portion is integrated to the body portion and the lid portion.

Another embodiment of a beverage container comprises a resilient pouch adapted to receive a fluid, the pouch comprising one or more outer surfaces and a pouch opening. The one or more outer surfaces are adapted to receive a pair of substantially opposing compressive forces. Furthermore, the pouch opening is adapted to expand from a substantially closed position to a substantially open position upon the one or more outer surfaces receiving the pair of substantially opposing compressive forces.

These and other embodiments are described in further detail herein.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings, wherein:

DETAILED DESCRIPTION

Figure 1:
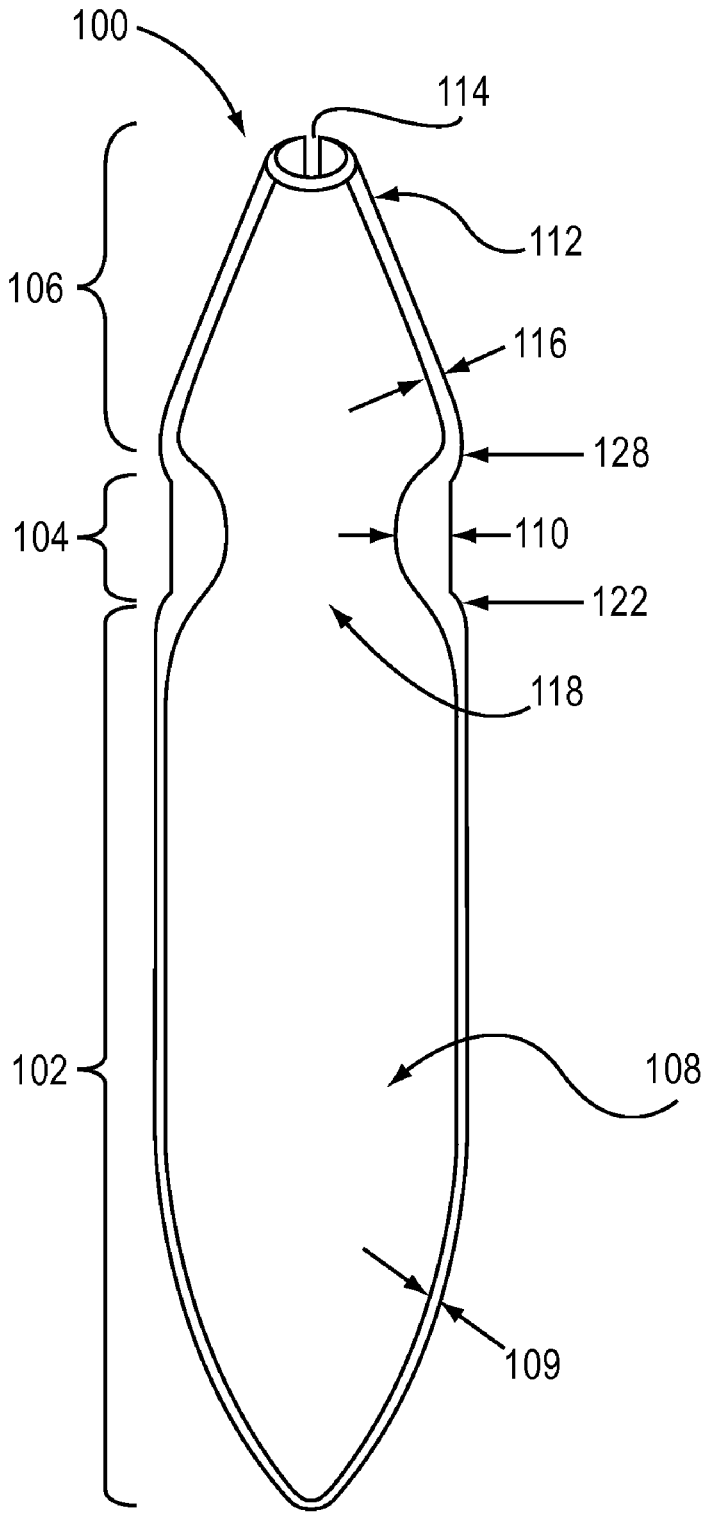
FIG. 1 is a front view of a beverage container.

Referring now to the drawings, where like or similar elements are designated with identical reference numerals throughout the several views where appropriate, and referring in particular to FIG. 1, shown is a beverage container 100 comprising a resilient body portion 102, a resilient ring portion 104, and a resilient lid portion 106. One embodiment comprises the body portion 102 defining an internal fluid reception cavity 108 and having a first thickness 109. The resilient ring portion 104 in one embodiment is integrated to the body portion 102, with the ring portion 104 having a second thickness 110. Furthermore, the resilient lid portion 106 is comprised of a spout 112 and a lid portion opening 114. The resilient lid portion 106 may have a third thickness 116, and may also integrate to the ring portion 104. In one embodiment, the third thickness 116 may generally equal the first thickness 109. As one example, the first thickness may be about 0.05 inches, the second thickness 110 may have a maximum thickness of about 0.25 inches, and the third thickness may be about 0.1 inches. It is contemplated that in at least one embodiment the lid portion 106, ring portion 104 and/or body portion 102 are unintegrated portions. For example, a resilient lid portion 106 and/or lid portion 106 and ring portion 104 combination may screwably couple to a rigid or non-rigid body portion 102.

Figure 2:
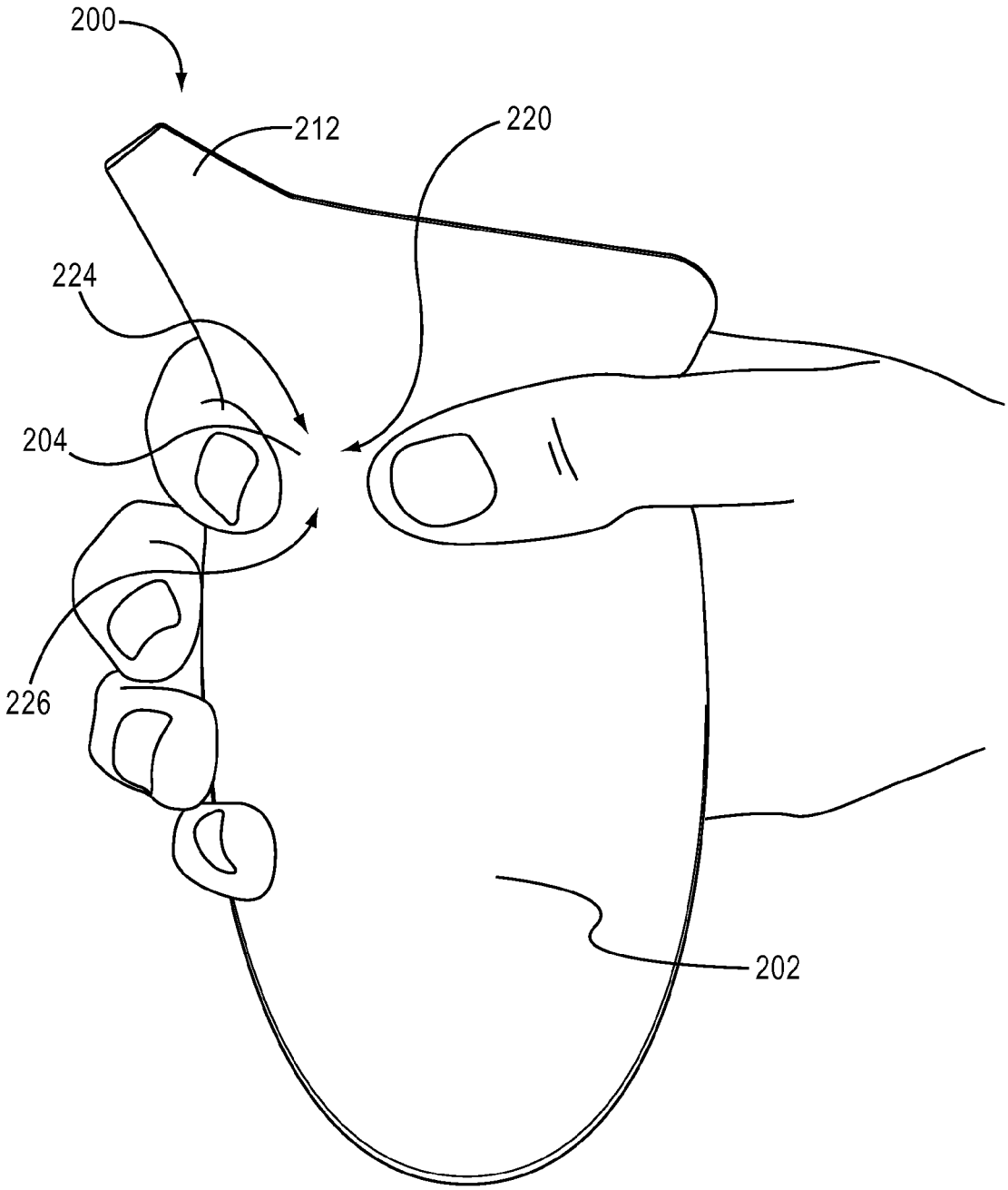
FIG. 2 is a side view of a beverage container being gripped by a hand.

As seen in FIGS. 1 & 2, one embodiment may comprise the body portion 102 having a body portion upper end 122, the body portion upper end 122 defining an opening 118 to the fluid reception cavity 108. Furthermore, the ring portion 104 may further comprise an outer surface 220, an upper end 224 and a lower end 226, with the ring lower end 226 being integrated to the body portion upper end 122. Likewise, the lid portion 106 may further comprise a lower end 128 integrated to the ring upper end 224. The lid portion 106 is adapted to keep the opening 114 substantially closed, preventing a fluid contained within the fluid reception cavity 108 from spilling out of the lid portion opening 114, absent intervention by a user.

Figure 3B:
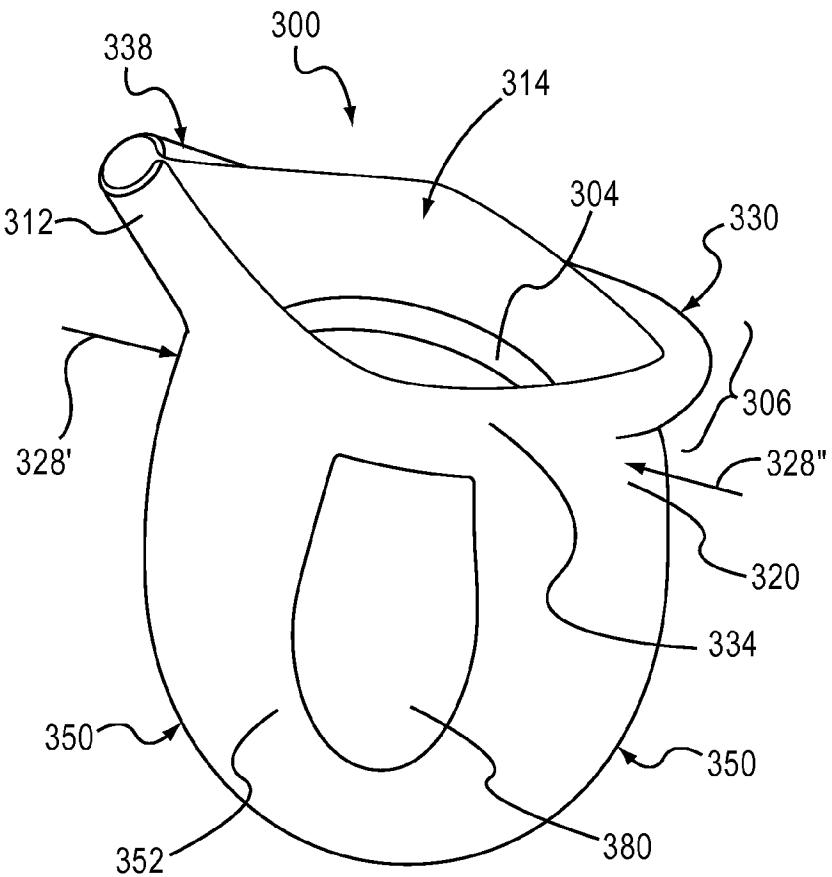
FIG. 3B is an isometric view of a beverage container with a beverage container opening in its open position.
Figure 3A:
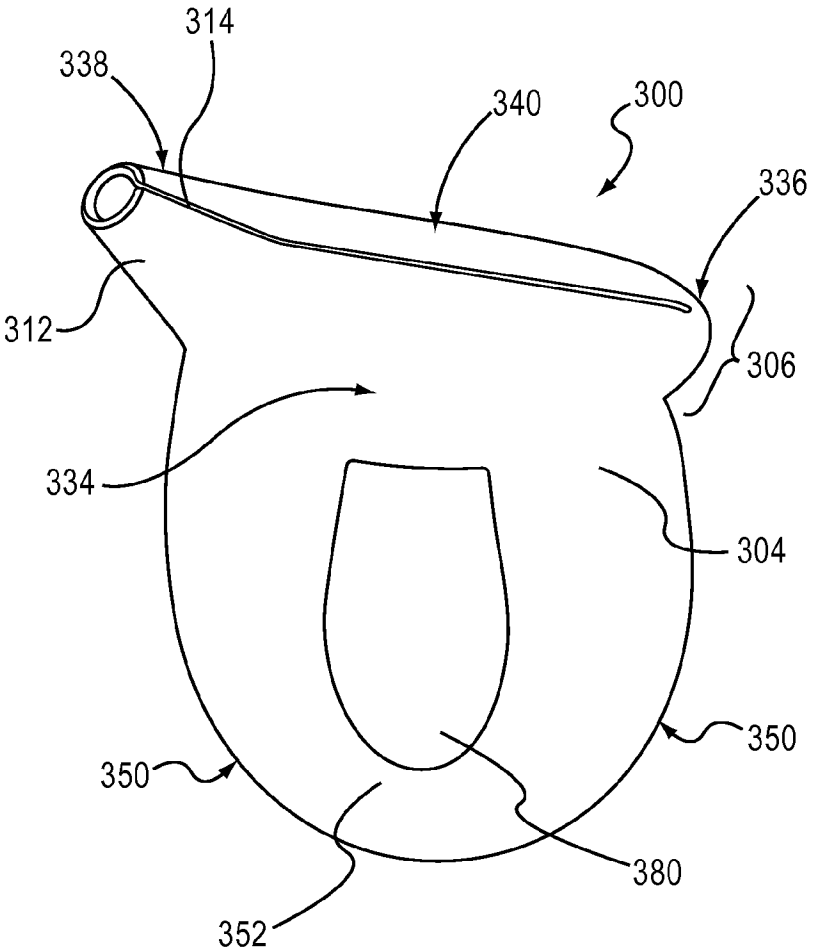
FIG. 3A is an isometric view of a beverage container with a beverage container opening in its closed position.
Figure 4A:
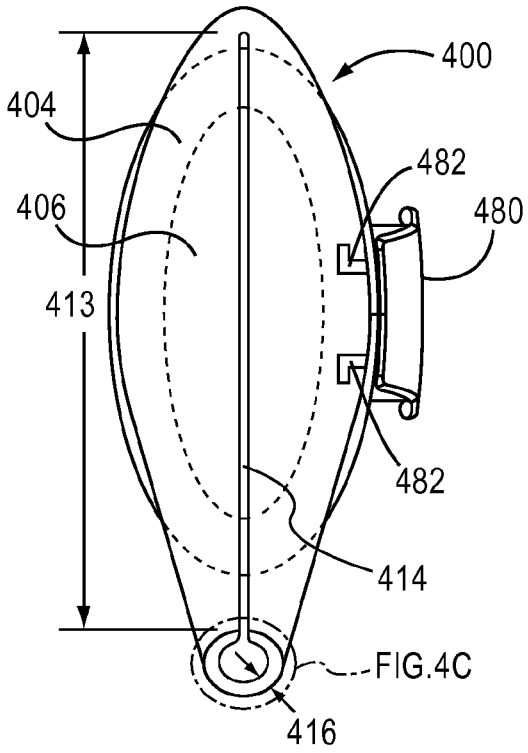
FIG. 4A is a top view of a beverage container with a beverage container opening in its closed position.
Figure 4B:
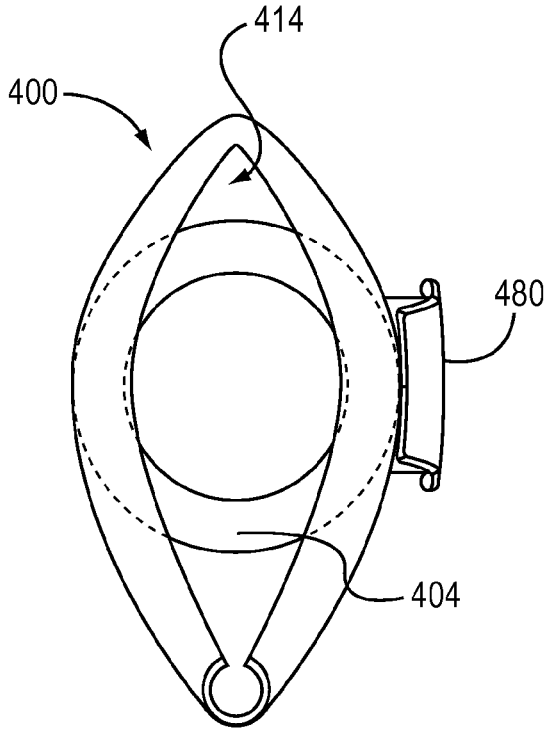
FIG. 4B is a top view of a beverage container with a beverage container opening in its open position.

As shown in FIGS. 3A and 4A, the opening 314, 414 in one embodiment comprises a slit. The slit is adapted to expand from a generally closed position, as shown in FIGS. 3A and 4A, to a generally open position, as shown in FIGS. 3B and 4B. The slit may be adapted to open upon a pair of generally opposing forces 328' and 328" being exerted on the ring outer surface 320. The pair of substantially opposing forces 328', 328" may be applied generally parallel to the slit.

As shown in FIG. 2, a beverage container 200 may be comprised of ring and body portions 204 and 202 adapted to be gripped by a person's hand. For example, the ring portion 204 in one embodiment may be adapted to receive an inner surface of a person's thumb and forefinger. Therefore, the opposing forces 328' and 328", shown in FIG. 3B, may be applied to the beverage container 200, 300 from squeezing the forefinger and thumb together.

As shown in FIGS. 4A & 4B, the ring portion 104 of the beverage container 400 (in FIG. 4A, shown by the dotted line) may be adapted to resiliently change from a generally elliptical shape having a major axis in a first direction to a generally elliptical shape having a major axis in a second direction. The major axis may change directions upon receiving the pair of generally opposing forces 328', 328" on the ring outer surface 320. One major axis second direction may be generally perpendicular to the major axis first direction.

Figure 4C:
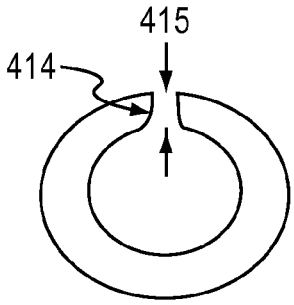
FIG. 4C is a front view of a spout end showing a slit depth.
Figure 5:
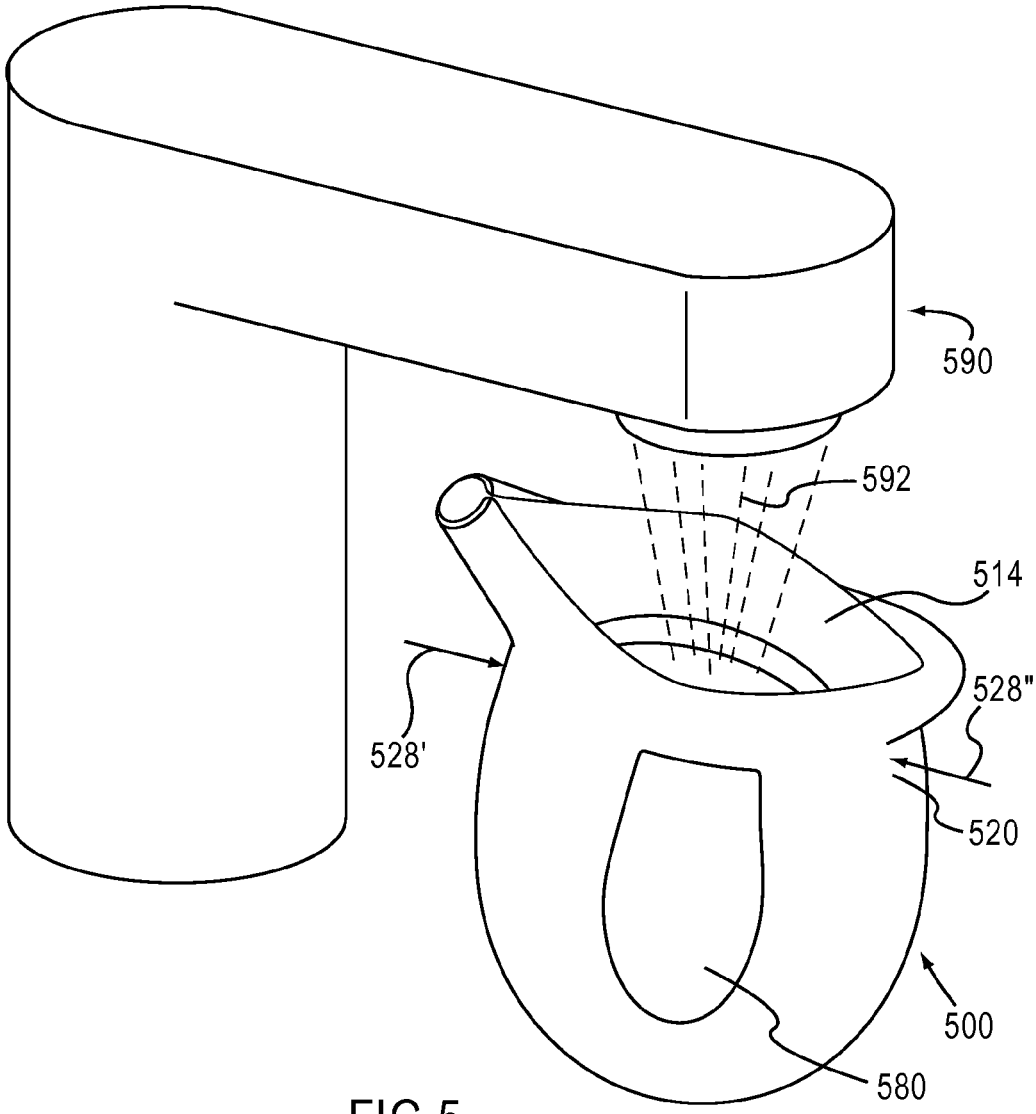

In looking at FIGS. 3B and 4A, one can see that the pair of generally opposing forces 328' and 328" may be initially applied to one or more sections of the ring portion 304, 404 which intersect with the major axis in the first direction. Furthermore, upon releasing the forces 328', 328", the slit returns from the open position shown in FIGS. 3B & 4B to the closed position shown in FIGS. 3A & 4A. Therefore, the ring portion 304, 404 in one embodiment is adapted to open and close the opening 314, 414 on the lid portion 306 upon receiving and releasing the forces 328', 328". As shown in FIGS. 4C & 4A, one slit has a slit depth 415 and a slit length 413, with the slit depth 415 being equal to the first thickness 416 and the slit length 413 generally extending from a spout end to the opposing top surface end 436. Therefore, a spout port may be integrated with the slit.

As shown in FIG. 3A, one embodiment of a beverage container 300 comprises a lid portion 306 having one or more side surfaces 334. Furthermore, the lid portion 306 is comprised of a generally elongated top surface 340 having a pair of opposing top surface ends 336, 338. The opening 314 may extend along a centerline of the top surface 340, from one top surface end to the other 336, 338. However, the spout 312 may also be integrated and extend radially from one of the pair of opposing top surface ends 336, 338. The spout 312 in one embodiment is adapted for fluid to be dispensed from the beverage container 300 in a laminar manner by pouring the fluid out of the spout opening.

One beverage container comprising the lid portion 106, ring portion, 104 and body portion 102 may be referred to as a pouch. One pouch embodiment may be comprised of one or more outer surfaces 120 adapted to receive the opposing forces 328', 328" which are adapted to open (and close, upon the release of the forces 328', 328") the pouch opening 114. Such a pouch operates in a manner similar to the previously described ring outer surface 120 and lid portion opening 114. For example, upon the one or more pouch outer surfaces 120 receiving the pair of substantially opposing compressive forces 328' 328", the pouch may be adapted to expand from the substantially closed position shown in FIGS. 3A & 4A to the substantially open position shown in FIGS. 3B & 4B.

As shown in FIGS. 3A & 3B, one embodiment is further comprised of one of a ring portion 104 and body portion 102 comprising a pair of generally opposing rounded first sides 350 and a perpendicularly aligned pair of generally opposing rounded second sides 352. The first sides 350 have a first length and the second sides 352 have a second length, the first length being less than the second length. The pair of substantially opposing compressive forces 328', 328" may be applied to the first sides 350 in on embodiment.

Upon expanding from a substantially closed position to a substantially open position, the slit in one embodiment may be changed from a first length and substantially invariable first width shown in FIGS. 3A & 4A, to a second length and a variable second width shown in FIGS. 3B & 4B. As shown, the second length may be shorter than the first length. Upon releasing the pair of substantially opposing forces 328', 328" from the outer surface of the beverage container, the pouch opening is adapted to contract from the substantially open position to the substantially closed position.

One beverage container 300, 400 may also be comprised of an attachment mechanism 380. The attachment mechanism 380 is adapted to couple the beverage container 300, 400 to a person, such as, but not limited to, a person participating in a sporting event. One attachment mechanism may be a belt clip. However other attachment mechanisms are also contemplated, such as, but not limited to, a strap adapted to fit around the ring portion 304, 404 such that the person may be able to slip his or her hand or wrist under the strap as well. The belt clip in one embodiment may be coupled to the beverage container through a strap. The strap may fit around the ring portion. Other belt clips may couple to the beverage container through a pair of prongs 482 adapted to fit within the ring portion, as shown in FIG. 4A. The prongs 482 may also be inserted through a wall of the beverage container 300, or may comprise a single prong 482 adapted to extend through the ring portion 404.

Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention.

What is claimed is:

1. A beverage container comprising, a resilient body portion defining a fluid reception cavity, the body portion having a first thickness; a unitary and continuous resilient ring portion integrated with the body portion and having an outer surface, the ring portion having a second thickness; a resilient lid portion having a third thickness and being integrated with the ring portion, said lid portion comprising at least two side surfaces, a generally elongated top surface, and a pair of opposing top surface ends, the top surface comprising a slit having a depth equal to the third thickness extending between the pair of opposing top surface ends and forming a first opening; and a resilient spout being integrated with the lid portion and extending radially from one of the pair of opposing top surface ends of said lid portion and forming a second opening; the slit of the lid portion extending from one of the pair of opposing top surface ends to the spout end along the top surface.

2. The beverage container of claim 1 wherein, the third material thickness substantially equals the first material thickness.

3. The beverage container of claim 1 wherein, the resilient lid portion, spout portion, ring portion, and body portion are comprised of an elastomeric polymer;

the first and third thicknesses comprising a thickness of one of less than and equal to about 0.1 inches; and a maximum second thickness comprises a thickness of one of less than and equal to about 0.25 inches.

4. The beverage container of claim 1 wherein, the slit is adapted to expand from a first position in which the slit is closed to a second position in which the slit is open upon a pair of generally opposing forces being exerted on the ring outer surface along the longitudinal axis of the ring, said slit being further adapted to contract from the second position in which the slit is open to the first position in which the slit is closed upon releasing the pair of generally opposing forces from the ring outer surface along the longitudinal axis of the ring.

5. The beverage container of claim 4 wherein, the ring and body portions are adapted to be gripped by a person's hand; and the opposing forces are adapted to be applied from a squeezing motion between, a person's forefinger and thumb.

6. The beverage container of claim 4 wherein, the ring portion is adapted to resiliently change from a generally elliptical shape having a major axis in a first direction to a generally elliptical shape having a major axis in a second direction upon receiving the pair of generally opposing forces on the ring outer surface;

the pair of generally opposing forces are applied to the ring outer surface intersecting the first direction major axis; and the second direction is generally perpendicular to the first direction.

7. The beverage container of claim 4 wherein, the first position in which the slit is closed comprises the slit having a first length and substantially invariable first width equal to or less than the third thickness; and the second position in which the slit is open comprises the slit having a second length and a variable second width, the second length being shorter than the first length and the second width being generally equal to the second length.

8. A beverage container closure assembly comprising, an attachment mechanism portion adapted to attach to a fluid reception cavity, the attachment mechanism having a first thickness; a unitary and continuous resilient ring portion with an outer surface and integrated with the attachment mechanism, the ring portion having a second thickness; a resilient lid portion having a third thickness and being integrated with the ring portion, said lid portion comprising at least two side surfaces, a generally elongated top surface, and a pair of opposing top surface ends, the top surface comprising a slit having a depth equal to the third thickness extending between the pair of opposing top surface ends and forming a first opening, and a resilient spout being integrated with the lid portion and extending radially from one of the pair of opposing top surface ends of said lid portion and forming a second opening; the slit of the lid portion extending from one of the pair of opposing top surface ends to the spout end along the top surface.

9. The beverage container closure assembly of claim 8 wherein, the slit is adapted to expand from a first position in which the slit is closed to a second position in which the slit is open upon a pair of generally opposing forces being exerted on the ring outer surface along the longitudinal axis of the ring, said slit being further adapted to contract from the second position in which the slit is open to the first position in which the slit is closed upon releasing the pair of generally opposing forces from the ring outer surface along the longitudinal axis of the ring.

10. The beverage container closure assembly of claim 9 wherein, the ring and connector portions are adapted to be gripped by a person's hand; and the opposing forces are adapted to be applied from a squeezing motion between a person's forefinger and thumb.

11. The beverage container closure assembly of claim 9 wherein, the ring portion is adapted to resiliently change from a generally elliptical shape having a major axis in a first direction to a generally elliptical shape having a major axis in a second direction upon receiving the pair of generally opposing forces on the ring outer surface;

the pair of generally opposing forces are applied to the ring outer surface intersecting the first direction major axis; and the second direction is generally perpendicular to the first direction.

12. The beverage container closure assembly of claim 9 wherein, the first position in which the slit is closed comprises the slit having a first length and substantially invariable first width equal to or less than the third thickness; and the second position in which the slit is open comprises the slit having a second length and a variable second width, the second length being shorter than the first length and the second width being generally equal to the second length.

13. The beverage container closure assembly of claim 8 wherein, the third material thickness substantially equals the first material thickness.

14. The beverage container closure assembly of claim 8 wherein, the resilient lid portion, spout portion, ring portion, and connector portion are comprised of an elastomeric polymer;

the first and third thicknesses comprising a thickness of one of less than and equal to about 0.1 inches; and a maximum second thickness comprises a thickness of one of less than and equal to about 0.25 inches.

* * * * *